US007175139B2

(12) United States Patent
Broeders

(10) Patent No.: US 7,175,139 B2
(45) Date of Patent: Feb. 13, 2007

(54) BAG HOLDER FOR HOLDING A BAG IN AN UPRIGHT AND OPEN POSITION

(75) Inventor: Nicholas C. Broeders, Inisfil (CA)

(73) Assignee: CPI Plastics Group Ltd., Mississauga (CA)

( * ) Notice: Subject to any disclaimer, the term of this patent is extended or adjusted under 35 U.S.C. 154(b) by 0 days.

(21) Appl. No.: 10/987,617

(22) Filed: Nov. 12, 2004

(65) Prior Publication Data

US 2006/0102809 A1 May 18, 2006

(51) Int. Cl.
*B65B 67/12* (2006.01)

(52) U.S. Cl. ..... 248/95; 248/100; 248/99; 211/12; 220/489

(58) Field of Classification Search ..... 248/95, 248/100, 101, 175, 302, 97, 99, 98, 150, 248/153, 907; 220/489, 495.06, 495.08, 220/495.1, 495.07, 522, 523, 6; 211/12, 211/84, 85.15, 85.31, 85, 195, 181.1
See application file for complete search history.

(56) References Cited

U.S. PATENT DOCUMENTS 447,686 A * 3/1891 Holladay ..... 248/97
996,421 A * 6/1911 McCausland ..... 211/51
3,175,793 A * 3/1965 Kennedy ..... 248/99
3,313,504 A 4/1967 Stoltze
3,861,125 A * 1/1975 Hagemeister ..... 53/390
4,139,029 A * 2/1979 Geraci ..... 141/98
4,445,658 A * 5/1984 Ferron ..... 248/99
4,458,867 A * 7/1984 Malik ..... 248/97
4,760,983 A * 8/1988 McNerney ..... 248/100
5,551,654 A * 9/1996 McNerney ..... 248/99

* cited by examiner

*Primary Examiner*—Kimberly T. Wood
(74) *Attorney, Agent, or Firm*—Phillips Lytle LLP

(57) ABSTRACT

A bag holder (75) is adapted to hold a flexible bag (B) in an upright and open position. The bag holder includes a wire-frame member (78) having a back portion, a top portion, a left side portion, and a right side portion, and a bag bottom support (91, 82) adapted to be mounted on the frame. The bag bottom support may be mounted on the frame in different positions so as accommodate different size bags. A lid (112) may close the upper end of the bag, and may have a bag storage compartment (116) therein. Preferably, the lid and cover is of one-piece construction.

21 Claims, 8 Drawing Sheets

20
21
22
23
24
25
26
63
64
P
A
B 78
80
81
82
79
76
83
84
86
88
89
91
92
93
94
95
96
98
99
100
101
102
103
104
105
106
107
108
109
110
111
118

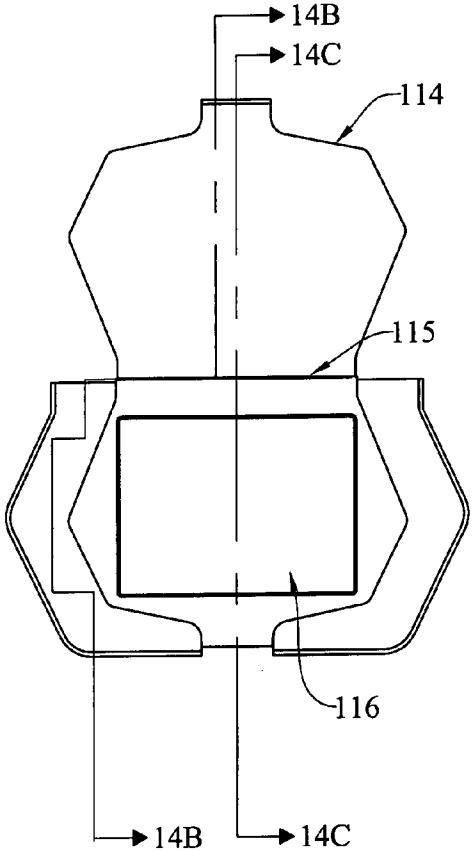
Fig. 13
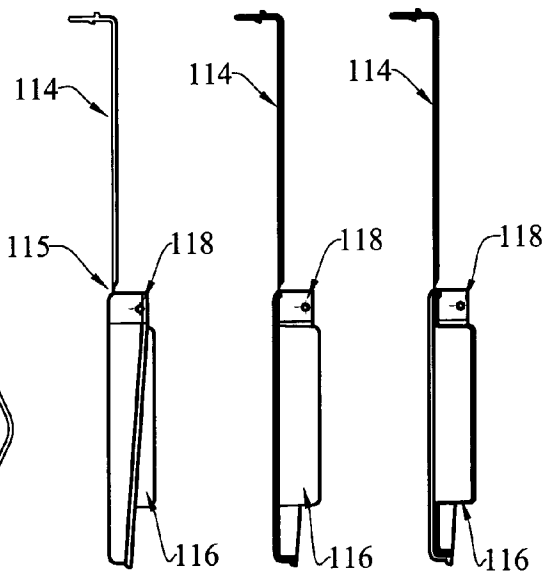
Fig. 14C
Fig. 14B
Fig. 14A
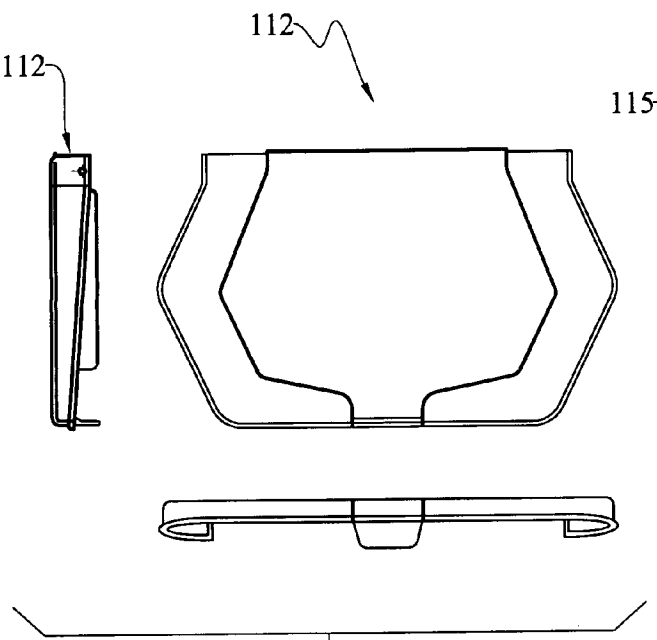
Fig. 12

P
76
B
A
112

80
76
78

76
80
78
81
82

76
80
78
81
82

76
80
78
81
82

76
112
78
81
82

BAG HOLDER FOR HOLDING A BAG IN AN UPRIGHT AND OPEN POSITION

TECHNICAL FIELD

The present invention relates generally to the field of bag holders and supports, and, more particularly, to various improvements in a bag holder for holding a flexible plastic bag in an upright and open position. The improved bag holder may be either mounted on a stand which is supported on a counter top or other horizontal support, or on a vertical object, such as the inside of a kitchen cabinet or cupboard door.

BACKGROUND ART

Wire-formed bag holders for flexible film-type plastic bags have been developed heretofore.

U.S. Pat. No. 3,313,504 discloses such a wire-formed bag holder, which is adapted to be mounted on the inside door of a kitchen cabinet, or otherwise secured to a vertical wall. Another embodiment was adapted to be mounted on a horizontal support. This member has a wire-frame section adapted to contain the bag. The wire-frame has an upper rim about which a marginal portion adjacent the open mouth of the bag may be placed, has a lower bag support, and has a means for supporting a roll of bags beneath the bag support. This device, however, appears to be adapted for use with one size of bag, and does not appear to be foldable into a compact size or container for purposes of display and sale.

U.S. Pat. No. 4,760,983 discloses another type of wire-formed bag holder. Again, the bag holder may stand on a suitable support, or may be mounted to a vertical surface, such as the inside of a cupboard door. This device has certain front and side loops so that the holder is adaptable for use with different types of bags. However, this device does not appear to be useable with different sizes of bags.

U.S. Pat. No. 5,551,654 discloses yet another bag holder for supporting open-mouth plastic bags. Here again, this patent discloses a bag holder having a number of hooks for use with different types of bags. However, this device does not appear to be foldable into a compact container for purposes of display and shipment.

While such bag holders are known and are believed to be in widespread use, they are commonly sold in dispenser racks in various retail outlets. These dispenser racks may be physically inclined such that as the consumer withdraws the container or package nearest to him, the additional packages in that rack will automatically advance forwardly toward the consumer to fill the void just created by the withdrawn package. In this regard, it would be desirable if an improved bag holder could be folded or otherwise placed into a compact package. This would readily lend itself to use with dispensers. Moreover, the smaller the package, the larger the number of such packages that could be held in a dispenser rack or on a store shelf. One problem that has been experienced heretofore is that if such packages are large in size, and are quickly sold out, store personnel will not refill the dispenser as soon as it is empty. Rather, they will wait for the next convenient opportunity, which may be at the end of the day in some cases or several days later in others. Hence, it would be highly desirable to package the bag holder in a small compact package such that a large number of such packages could be placed in a dispenser or on a store shelf.

In addition, it would be desirable to provide an improved bag holder that is capable of use with different sizes of bags.

It would be further desirable to provide an improved lid for use with such a bag holder, wherein the lid contains a closable compartment for storing fresh bags in an immediately-available ready-to-use position.

It would be further desirable to have an improved wire-formed bag holder in which certain in-turned portions are insertable into eyes at skewed angles such that the in-turned end portions may not be freely and easily pulled from the eyes.

It would be further desirable to provided an improved bag holder for use with bags having capacities of about 21 liters, wherein the various portions of the wire-frame member may be placed into an elongated rectangular package having a transverse cross-sectional area of less than about 37.0 square inches.

It would be further desirable to provide an improved bag holder for use with a bag having a capacity of about 6½ liters, wherein the wire-frame member may be placed into an elongated rectangular package having a transverse cross-sectional area of less than about 30.0 square inches.

It would be further desirable to provide an improved bag holder for use with bags having 15 and 21 liter capacities.

DISCLOSURE OF THE INVENTION

With parenthetical reference to the corresponding parts, portions or surfaces of the disclosed embodiment, merely for purposes of illustration and not by way of limitation, the present invention provides various improvements in a bag holder for holding a flexible film-type bag in an upright and open position.

In one aspect the improved bag holder (75) comprises: a wire-formed member (76) having back portion, a top portion, a left side portion, and a right side portion; and a bag bottom support (81,82) adapted to be mounted on the member in a first position (i.e., as shown in FIG. 9) for supporting a bag of one size, and in another position for supporting a bag of another size (i.e., as shown in FIG. 10); whereby the bag holder is adapted to hold bags of two different sizes.

In the preferred form, the back portion has two horizontally-extending bars (107, 107) at vertically-spaced locations thereon. The bag bottom support may have at least one hook (102) adapted to be engaged with either of the bars. The bag bottom support may include a first portion (81) that is adapted to be attached to the member, and a second portion (82) that is pivotally connected to the first portion. One of the bag bottom support portions may include a stop (105) for engaging the other of the bag bottom support portions for limiting pivotal movement of the bag bottom second portion relative to the bag bottom first portion. The bag bottom support portions may be formed of wire. The bag bottom second portion (82) may be of one-piece construction. Each of the side portions has integral hook portions that extend toward the back portion. The one size bag may be about 15 liters, and the other size bag may be about 21 liters.

The top portion (80) may be of one-piece construction. A lid may be mounted on, or otherwise supported by, the top portion. The lid (112) may be have means, such as a compartment (116), for storing a plurality of unused bags, and a cover (114) for selectively closing the compartment. The lid and cover may be formed of a flexible polymer, and may be of one-piece construction.

In a second aspect, the bag holder (75) includes a wire-formed member (78) having atop portion (80), and the improvement comprises: a lid (112) pivotally mounted on the member for selective movement between an open position (i.e., as shown in FIG. 10) at which the open mouth of the bag will be exposed, and a closed position (i.e., as shown in FIG. 9) at which the open mouth of the bag will be concealed; the lid having a receptacle (116) opening on to its upper surface; and a cover (114) pivotally mounted on the lid and adapted to be moved between an open position at which the receptacle will be exposed, and a closed position at which the receptacle will be concealed; whereby the receptacle is adapted to store a quantity of bags for use on the bag holder.

In a preferred form, the lid is formed of a flexible polymer, and is of one-piece construction. One of the lid and cover may have a detent and the other of the lid and cover may have a recess, the detent and recess being operatively arranged such that the cover may be snapped closed on the lid. A living hinge (115) may be provided between the cover and lid.

In a third aspect, the improvement comprises: a wire-formed member (22,23,26) having a back portion, a left side portion, a right side portion, and a top portion; the top portion being pivotally connected to the back portion and adapted to be moved between a first position at which the top portion lies adjacent the back portion (i.e., as shown in FIG. 5B), and a second position (i.e., as shown in FIG. 5C) at which the top portion extends away from the back portion substantially at a right angle relative thereto; wherein the top portion has eyes (62, 62) formed therein; and wherein the left and right side portions have in-turned marginal end portions (42, 42) that are adapted to be received in the top portion eyes when the top portion is in the second position to hold the top portion in the second position. In a preferred form, the axis of at least one in-turned end portion is not coincident with the axis of the associated eye.

The bag holder may further include: a bag bottom support (24, 25) adapted to be mounted on the wire-formed member in a first position (i.e., as shown in FIG. 9) for supporting a bag on one size, and in another position (i.e., as shown in FIG. 10) for supporting a bag of another size; whereby bag holder is adapted to hold bags of two different sizes. The bag bottom support may be adapted to be selectively attached to the back portion. The bag bottom support may have a first portion (81) adapted to be selectively attached to the back portion, and a second portion (82) pivotally mounted on the first portion and adapted to be selectively moved between a first position at which the second portion is adapted to lie adjacent the first portion, and a second position at which the second position is adapted to be supported at an obtuse included angle relative to the first portion.

The bag holder may further include a lid (112) adapted to rest on, and be supported by, the top portion when the top portion is in the second position. The top portion may be of one-piece construction. The bag holder may be adapted for use with bags having a capacity of about 21 liters, and wherein the wire-frame member, the bag bottom support and the lid may be placed into an elongated rectangular package having a transverse cross-sectional area of about 36.69 square inches for shipping. The transverse dimensions of the package may be about 3.8125 inches by about 9.625 inches.

In a fourth aspect, the improved bag holder (75) is adapted to be used with a bag having a capacity of about 21 liters, and broadly comprises: wire-frame member (78) adapted to hold a bag in an upright open position; a bag bottom support (81, 82) mounted on the wire-frame member; and a lid (112) mounted on the wire-frame member; wherein the wire-frame member, the bag bottom support and the lid may be placed into an elongated rectangular package having a transverse cross-sectional area of less than about 37.0 square inches. In a preferred form, the transverse dimensions of the package are about 3.8125 inches by about 9.625 inches.

In a fifth aspect, the invention provides an improved bag holder (20) for use with a bag having a capacity of about 6½ liters, and which broadly comprises: wire-frame member (22, 23) adapted to hold a bag in an upright open position; a bag bottom support (24, 25) mounted on the wire-frame member; and a lid (64) mounted on the wire-frame member; wherein the wire-frame member, the bag bottom support and the lid may be placed into an elongated rectangular package having a transverse cross-sectional area of less than about 30.0 square inches. In a preferred form, the transverse dimensions of the package are about 4.0 inches by about 7.5 inches.

Accordingly, the general object of the invention is to provide an improved bag holder for holding a flexible, typically plastic, bag in an upright and open position. Another object is to proved an improved bag holder having a bag bottom support that is adapted to be mounted on a wire-formed member in at least two positions for supporting bags of different sizes.

Another object is to provide an improved lid that is adapted to be mounted on such a bag holder.

Another object is to proved a wire-formed bag holder in which in-turned end portions are insertable at skewed angles in eyes such that the in-turned end portions are somewhat restrained from freely withdrawing from the eyes.

Another object is to provide an improved bag holder for use with a bag having a capacity of about 6½ liters, and wherein the wire-frame member, the bag bottom support and the lid may be placed into an elongated rectangular package having a cross-sectional area of about 30.0 square inches, and, preferably, transverse dimensions of about 4.0 inches by about 7.5 inches.

Still another object is to provide an improved bag holder for use with a bag having a capacity of about 21 liters, and wherein the wire-frame member, the bag bottom support and the lid may be placed into an elongated rectangular package having a cross-sectional area of about 36.69 square inches, and, preferably, transverse dimensions of about 3.8125 inches by about 9.625 inches.

These and other objects and advantages will be come apparent from the foregoing and ongoing written specification, the drawings and the appended claims.

BRIEF DESCRIPTION OF THE DRAWINGS

FIG. 12 is a collection of front elevation, top plan and left side elevations of the lid shown in FIGS. 8–10.

FIG. 13 is a top plan view of the lid shown in FIG. 12, and showing the cover as having been opened so as to expose the bag-storage compartment within the lid.

FIG. 14A is a right side elevation of the lid shown in FIG. 13.

FIG. 14B is a fragmentary vertical sectional view thereof, taken generally on line 14B—14B of FIG. 13, showing a portion of the lid in section, but showing a left side elevation of the bag-storage compartment.

FIG. 14C is a view taken generally on line 14C—14C of FIG. 13, and showing the lid, cover and bag-storage compartment in central cross-section.

DESCRIPTION OF THE PREFERRED EMBODIMENTS

Figures 1, 2, 3A, 3B:
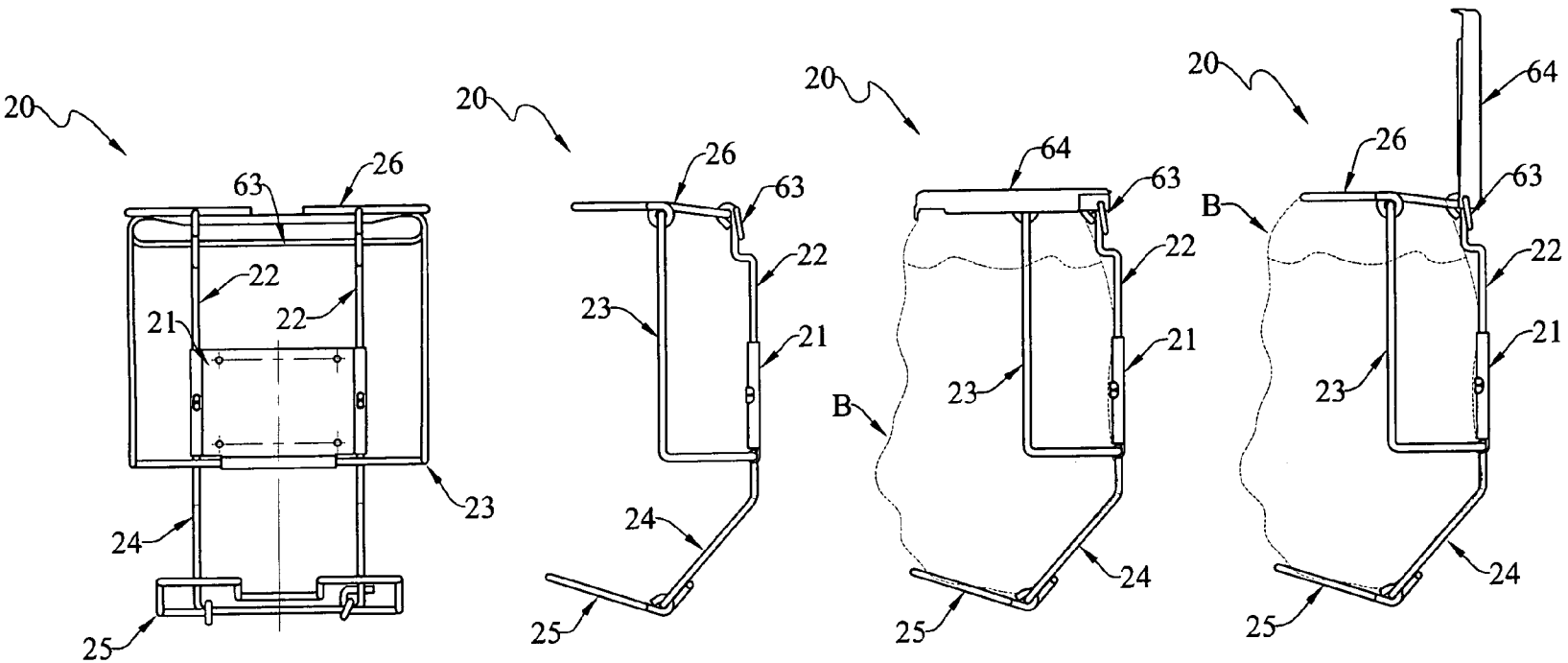
FIG. 1 is a front elevation of a first form of the improved bag holder, suitable for use with 6½ liter flexible bags.
FIG. 2 is a right side elevation of the bag holder as shown in FIG. 1.
FIG. 3A is right side elevation of the bag holder as shown in FIG. 2, but showing the lid as resting on the top rim of the wire-frame member.
FIG. 3B is a view similar to FIG. 3A, but showing the lid as having been moved to its raised or upright position so as to afford access to the bag.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

First Embodiment (FIGS. 1–5)

Referring now to the drawings, and, more particularly, to FIGS. 1–5, and specifically including FIGS. 5A–5F, a first form of the improved bag holder is generally indicated at 20. This form is particularly suited for use with 6½ liter flexible plastic bags, although this size or capacity could readily be varied.

The apparatus is shown as having a bracket 21 adapted to be mounted on a vertical support, such as the inside of a cupboard door or the like; two upper members, severally indicated at 22, mounted on the bracket and extending upwardly therefrom; a side member 23; a bag support subassembly that includes a bag support upper part 24 and a bag support lower part 25 pivotally mounted on upper part 24; and a top rim member, generally indicated at 26.

Figures 4A, 4B, 4C, 4D, 4E, 4F:
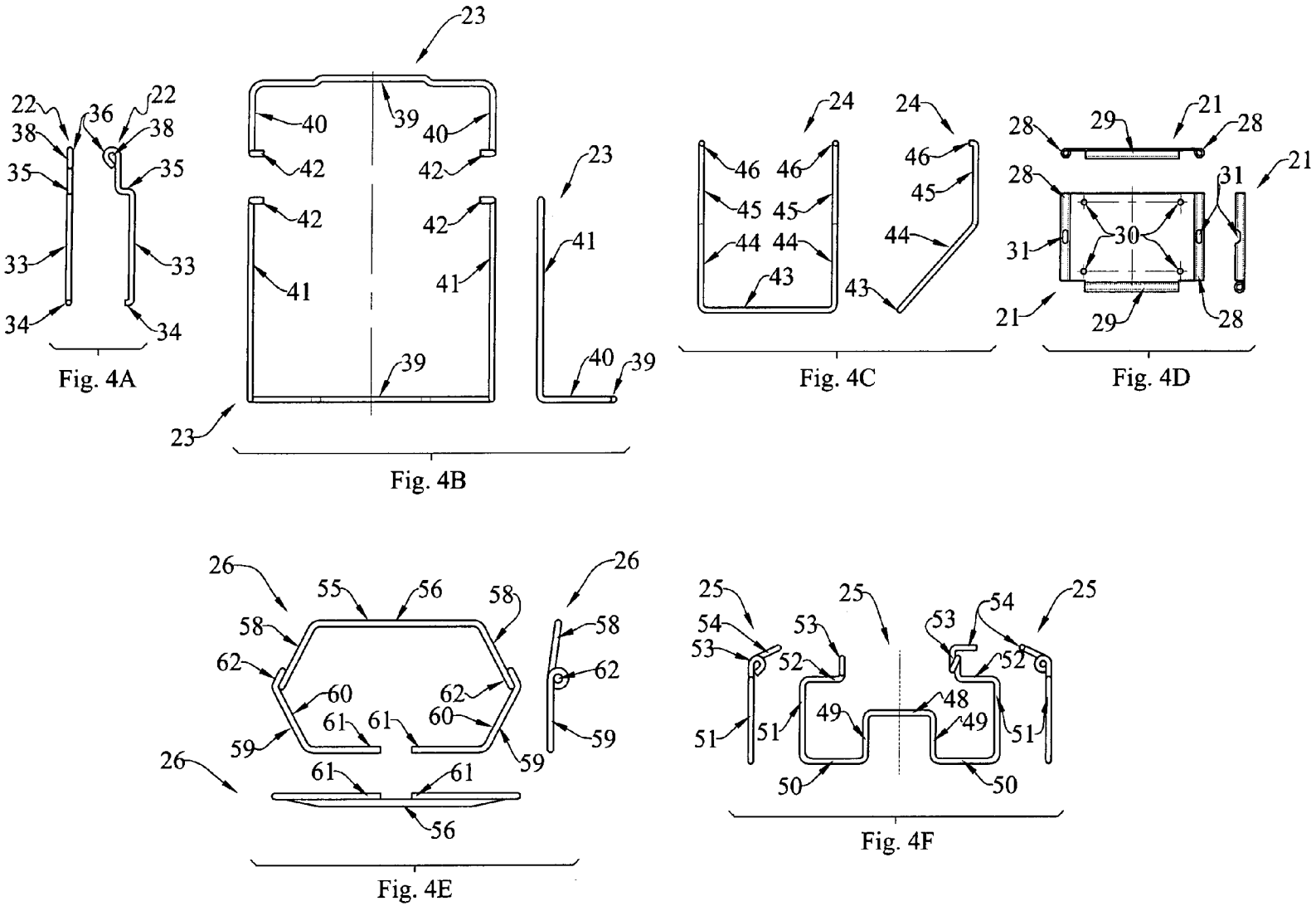
FIG. 4A is a collection of front and right side elevations of the upper frame member as shown in FIG. 1.
FIG. 4B are front, top plan and right side elevations of the side member shown in FIG. 1.
FIG. 4C is a collection of front and right side elevations of the bag support first member shown in FIG. 1.
FIG. 4D is a collection of front, top plan and right side elevations of the bracket member shown in FIG. 1.
FIG. 4E is a collection of front, top plan and right side elevations of the top rim member shown in FIG. 1.
FIG. 4F is a collection of left side, front and right side elevations of the bag support second member shown in FIG. 1.

As best shown in FIG. 4D, bracket 21 is shown as being a generally rectangular plate-like member having left and right rolled portions, severally indicated at 28, and a lower rolled portion 29. The plate-like portion is provided with four mounting holes, severally indicated at 30, that are designed to accommodate passage of the shank portions of suitable fasteners by means of which the bracket may be mounted on a suitable support, such as the inside of a cupboard or cabinet door, or some other vertical support. The rolled portions 28, 28 and 29 are adapted to receive insertion of other portions of the wire-frame member, as discussed infra. Left and right rolled portions 28,28 are severally provided with forwardly-facing middle openings, severally indicated at 31.

Referring now to FIG. 4A, the two upper portions 22 are shown as being specially-configured members. Each upper member 22 has a vertically-elongated portion 33, with a lowermost forwardly-facing marginal end portion 34, an intermediate horizontal portion 35, and an upper portion 36 extending upwardly therefrom and terminating in a rounded eye 38. As shown in FIGS. 1 and 2, the lower marginal end portions of upper members 22 are adapted to be inserted into the left and right rolled portions 28 of the bracket until such time that their lowermost forwardly-facing marginal end portions 34 extend through openings 31. These marginal end portions prevent the upper members from being unintentionally withdrawn from the bracket member.

Referring now to FIG. 4B, the side member is shown as being a specially-configured wire-formed member having a lowermost horizontal cross portion 39, two portions 40, 40 extending forwardly from the left and right marginal end portions of portion 39, two vertical portions 41,41 extending upwardly from the forward margins of portions 40, 40 and terminating in in-turned horizontal marginal end portions, severally indicated at 42. Cross bar portion 39 is adapted to be received in bracket lower rolled portion 29.

Referring now to FIG. 4C, the bag support first member 24 is shown as being a somewhat U-shaped member having a lowermost central cross portion 43, with intermediate portions 44,44 extending upwardly and rearwardly from its marginal end portions, vertical portions 45,45 continuing upwardly therefrom, and uppermost forwardly-extending marginal end portions 46, 46. The upper marginal end portions of the bag support first member are adapted to be slidably inserted into the open lower ends of bracket rolled portions 28 until such time as the forwardly-extending marginal end portions 46 thereof extend through bracket openings 31. Thus, the bag support may simply hang from the bracket member, and will not become separated therefrom unless an operator were to manipulate the bag support subassembly so as to withdraw the marginal end portions 46 from the openings of the brackets side rolled portions.

Figures 5A, 5B, 5C, 5D, 5E, 5F:
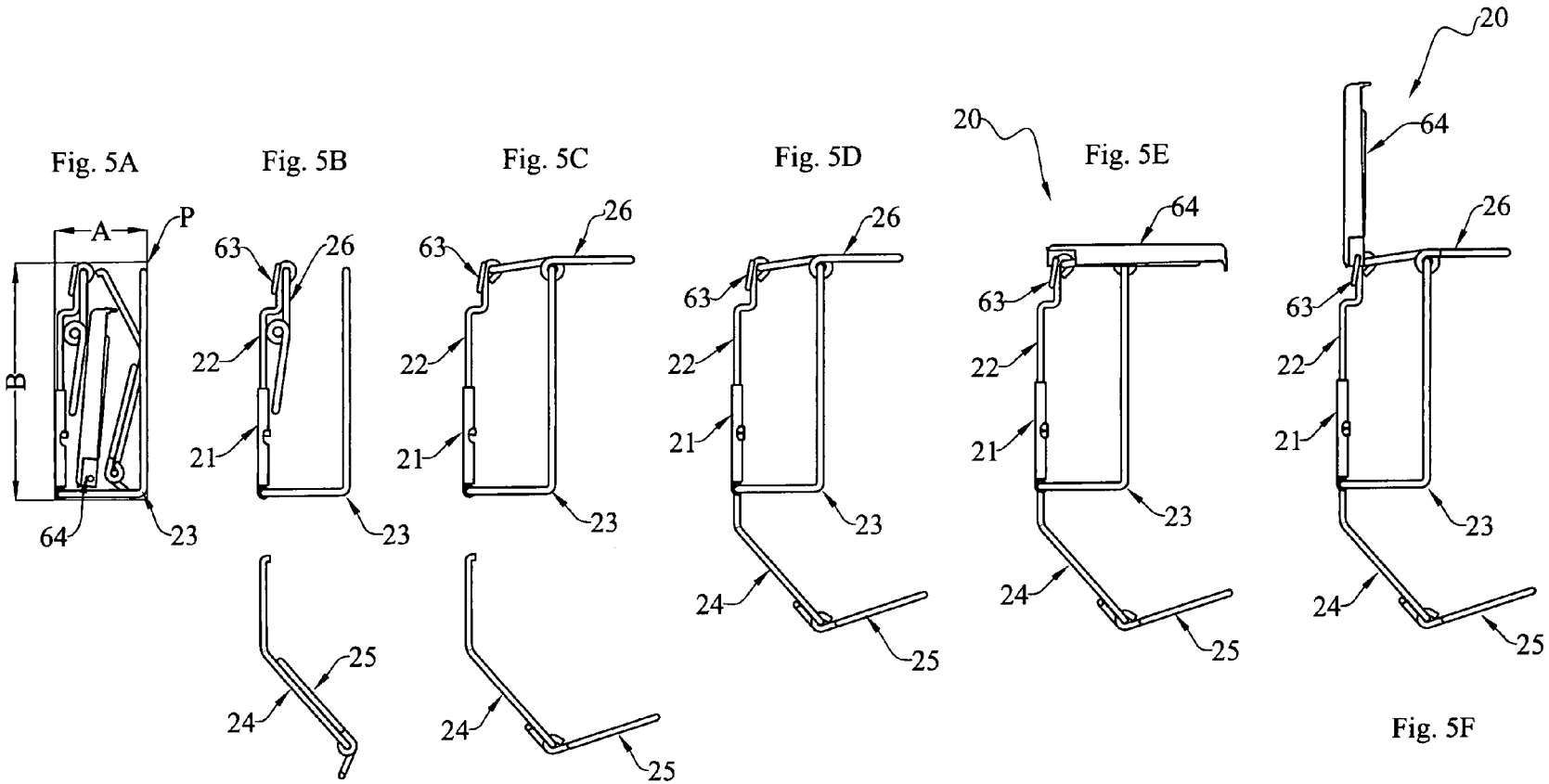
FIG. 5A is a transverse fragmentary elevational view of the bag holder shown in FIG. 1 as contained within a rectangular package.
FIG. 5B is a view similar to FIG. 5A, but showing the lid and the bag support subassembly as having been removed from the package.
FIG. 5C is a view similar to FIG. 5B, and depicting the top rim member as having been rotated through approximately 90° to a horizontally-extending position, with the in-turned marginal end portions of the side member being received in the top rim eyes, with the bag support second member rotated to its operative position, and with the bag support subassembly arranged in spaced relation to the frame member.
FIG. 5D is a view generally similar to FIG. 5C, but showing the bag support subassembly as having moved upwardly such that the upper marginal end portions of the bag support first member are operatively received and held in the bracket.
FIG. 5E is a view generally similar to FIG. 5D, but showing the lid as having been placed on top of the top rim, this view showing the lid as being in its lowered or closed position.
FIG. 5F is a view generally similar to FIG. 5E, but showing the lid as having been moved to its upright or raised position.

Referring now to FIG. 4F, bag support second member 25 is shown as being a specially-configured member having a central horizontal cross portion 48; two left and right portions, severally indicated at 49,49, extending downwardly therefrom; horizontal portions 50, 50 extending outwardly from the marginal end portions of members 49,49; outer portions 51,51 extending upwardly therefrom; horizontal portions 52,52 extending inwardly therefrom, and rolled portions forming eyes 53,53. In addition, another portion, indicated at 54, extends upwardly and outwardly from right eye 53. As best shown in FIG. 1, eyes 53, 53 are adapted to be wrapped around bag support first member portion 43, with portion 54 extending behind upstanding leg 44. Hence, the bag support second member is pivotally mounted on the bag support first member. The bag support second member is adapted to be moved to a first position (as shown in FIG. 5A) at which it is folded and lies closely against the bag support first portion, or rotated in a counter-clockwise direction to an outwardly-extending operative position (as shown in FIGS. 2, 3A and 3B) at which the bag support second portion forms an obtuse included angle of about 115° with respect to the bag support first portion.

Referring now to FIG. 4E, the top rim member 26 is shown as being formed of three pieces. The rear piece 55 has a central portion 56, and two forwardly- and laterally-extending left and right side portions 58, 58. Left and right portions 59, 59 are joined to the distal ends of portions 58, 58, and have portions 60, 60 extending forwardly and inwardly therefrom, and distal marginal end portions 61,61 extending horizontal toward one another. The juncture between parts 59 and 58 are in the form of rolled eyes, severally indicated at 62.

As best shown in FIGS. 1 and 2, the eyes 38 of upper frame members 22 are adapted to encircle top rim rear portion 55. Hence, the top rim is pivotally mounted on the upper members. When shipped, it is adapted to lie adjacent the upper members.

However, the top rim may be pivotally moved to the outwardly-extending position shown in FIG. 2. Once in this position, the in-turned marginal end portions 42 of the side member are adapted to be received in eyes 62. It should also be noted that the marginal end portions are inclined ast a skewed angle with respect to the axis of the eyes so as to impede their free and unintended removal therefrom.

As best shown in FIG. 3A, a lid is adapted to be pivotally mounted on the assembled frame member, with the in-turned marginal end portions of C-shaped member 63 received in openings provided in the lid. Hence, the lid may be moved between a closed horizontal position (as shown in FIG. 3A), at which the lid rests on the top rim member, or may be moved to an upright position (as shown in FIG. 3B), to afford access to a bag B being held within the frame. In FIG. 3A, the closed lid normally closes the open mouth of a paper held by the frame, whereas in FIG. 3B, the frame mouth is open so as to allow access to the bag.

While not shown in the drawings, the upper frame member and/or top rim may be provided with a number of hooks so as to receive and capture openings or handles in the bags so as to hold it in its operative position.

In this first embodiment, the wire-frame member is sized for holding a 6½ liter bag, although this size could be readily changed, as desired or needed.

FIGS. 5A–5F illustrate the series of steps needed to remove a bag from its package, indicated at P in FIG. 5A to its open operative position shown in FIG. 5F. First, the device is adapted to fit within an elongated rectangular package fee having transverse dimensions of "B" and "A", respectively, as shown in FIG. 5A. Thus, the device is adapted to be placed within a compact package, which facilitates its use on display and dispensing type racks. In the preferred embodiment, dimension "A" is about 4.0 inches, dimension "B" is about 7.5 inches, and the transverse cross-sectional area of the package P is about 30.0 square inches.

FIG. 5B shows the device as having been removed from its package, and the lid and the bag support subassemblies as having been separated therefrom.

FIG. 5C shows the lower bag support member as having been moved to is operative position, and further shows the top rim as having been moved through an angle of about 90° to its horizontal position, and the skewed in-turned marginal end portions of side member 23 being received in eyes 62.

FIG. 5D shows the open bag support mechanism as having been moved upwardly so that the upper marginal end portion of bag support first member 24 will be received in the side rolled portions of the bracket.

FIG. 5E depicts the lid as having been placed on the top rim portion, and also shows the lid as being in a closed position.

Finally, FIG. 5F is a view generally similar to FIG. 5E, but shows the lid as having been moved to its opened position.

Figures 6A, 6B, 6C:
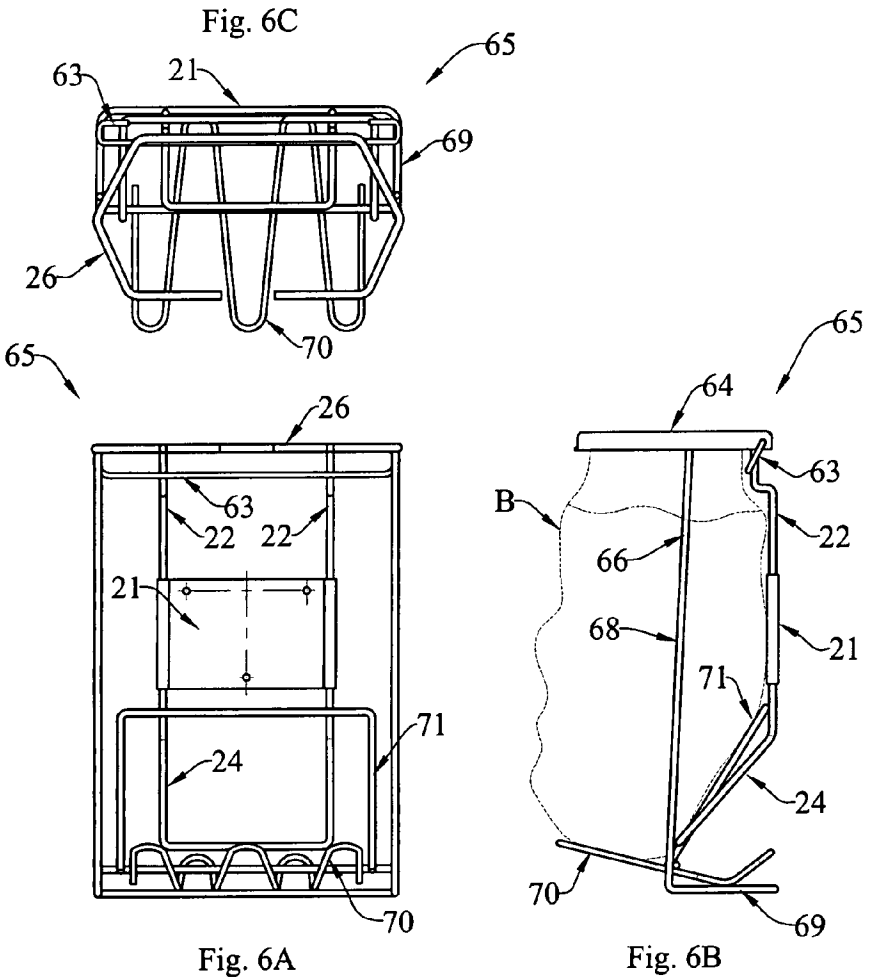
FIG. 6A is a front elevation of a variant form of the bag holder shown in FIG. 1, this version being adapted to stand on a horizontal surface, such as a counter.
FIG. 6B is a right side elevation of the bag holder shown in FIG. 6A, and further showing the lid as resting on the top rim.
FIG. 6C is a top plan view of the bag holder without the lid, as shown in FIG. 6A.

Variant-form Counter-supported Embodiment (FIGS. 6A–6C)

FIGS. 6A–6C show a variant form of the 6½ liter bag holder depicted in FIGS. 1–5. Here again, this device, generally indicated at 65, has bracket 21, upper members 22, 22, top rim 26, C-shaped member 63 and bag support first member 24. However, side member 42 has been replaced by a new member, generally indicated at 66. New member 66 has an elongated vertically- and rearwardly-inclined portion 68, with a horizontally-extending portion 69 extending rearwardly from its lower marginal end portion. The upper marginal ends of portions 68 are in-turned, and are received in the eyes provided in the top rim. In addition, a suitable bag support mechanism, including members 70 and 71 are operatively engaged with member 66, and with bag support member 24. Hence, whereas the embodiment shown in FIGS. 1–5 was adapted to be mounted on a vertical support by means of suitable fasteners placed through bracket mounting holes 30, the forms shown in FIGS. 6A–6B is adapted to stand freely on a horizontal surface, such as a counter top.

Thus, with respect to the first embodiment, depicted in FIGS. 1-6, it may be either mounted on a vertical support, such as the inside of a cupboard or cabinet door, or may be free standing member that may simply rest on a counter top, or some other horizontal support.

Second Embodiments (FIGS. 7–15)

Referring now to FIGS. 7–15, a second form of the improved bag holder is generally indicated at 75. This form is shown as including a bracket member 76, a specially-configured frame member 78, a C-shaped lid-engaging member 79, a top rim 80, and a bag support including a first portion 81 and a second portion 82 pivotally mounted on the first portion.

Figures 11A, 11B, 11C, 11D, 11E, 11F:
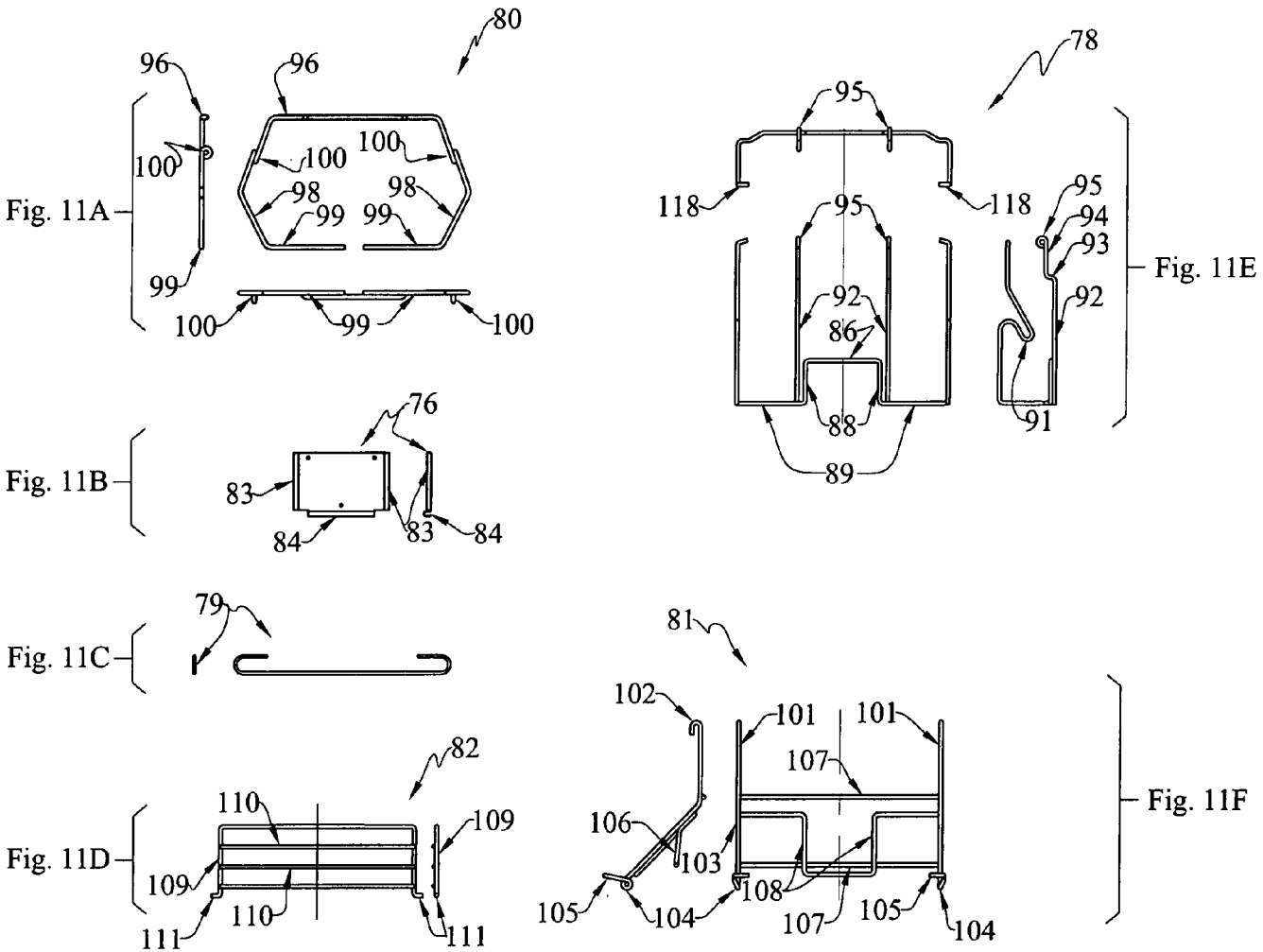
FIG. 11A is a collection of left side, top plan and front elevations of the top rim member shown in FIG. 7.
FIG. 11B is a collection of front and right side elevations of the bracket member shown in FIG. 7.
FIG. 11C is a collection of left side and front elevations of the lid-engaging member shown in FIG. 7.
FIG. 11D is a collection of front and right side elevations of the bag support second member shown in FIG. 7.
FIG. 11E is a collection of front, top plan and right side elevations of the bag frame as shown in FIG. 7.
FIG. 11F is a collection of left side and front elevations of the bag support first member shown in FIG. 7.

As best shown in FIG. 11B, the bracket is a specially-configured member somewhat similar to the bracket of the first embodiment, and having a central plate-like portion provide with left and right rolled portions 83, 83, and with a lower rolled C-shaped portion 84. The bracket is provided with three spaced mounting holes, severally indicated at 85, that are adapted to accommodate passage of the threaded shank portions of a corresponding number of fasteners (not shown) by means of which the wire-frame member may be mounted on a vertical surface, such as the inside surface of a cupboard or cabinet door. Rolled portions 83 may be either closed, or C-shaped, as desired.

Referring now to FIG. 11A, the bag frame 78 is shown as being a specially-configured member having a central portion 86, severally indicated at 88 extending downwardly from the left and right margins thereof, lateral portions 89, 89 extending leftwardly and rightwardly therefrom, and vertical portions 90, 90 extending upwardly therefrom. As best shown in the side view, these vertical portions have hooks, indicated at 91, to receive and hold bag handle openings. Other portions 92, 92 extend vertically-upwardly from the rear of the frame. These upper portions have forwardly extending portions 93, and upper portions 94 continuing upwardly therefrom and rolled to form eyes, severally indicated at 95. These eyes are wrapped around the rear cross bar of top rim 80.

As best shown in FIG. 11A, the top rim 80 is formed of three pieces: a rear piece 96 about which eyes 95 are wrapped, and left and right forward portions 98, 98 that terminate in in-turned horizontal portions 99, 99. The juncture between portions 96 and 98 are rolled as eyes, severally indicated at 100.

Referring now to FIG. 11F, the bag support upper member is shown as being a specially-configured member having left and right side supports, severally indicated at 101. Each side support terminates in an uppermost portion 101. Each side support terminates in an uppermost portion 102. At their lower ends, the side supports join inclined portions 103 that extend downwardly and forwardly therefrom, and which terminate in marginal end portions having eyes 104 and in-turned marginal end portions 105. A suitable support 106 for supporting an unused roll of bags may be mounted to the underside of bag support frame 81. Another portion 108 may be mounted on the side supports 101, and may have an undulating or U-shaped cross section so as to support a portion of a bag.

Referring now to FIG. 11D, the bag support lower part 82 is shown as being a grill-like member having left and right side portions 109 and a plurality of horizontal bars, severally indicated at 110. The lower marginal end portions of side supports 109 are shown as being out-turned, as indicated at 111. These out-turned end portions are adapted to be received in bag support first frame member eyes 105, as shown in FIGS. 7–10.

Figure 10:
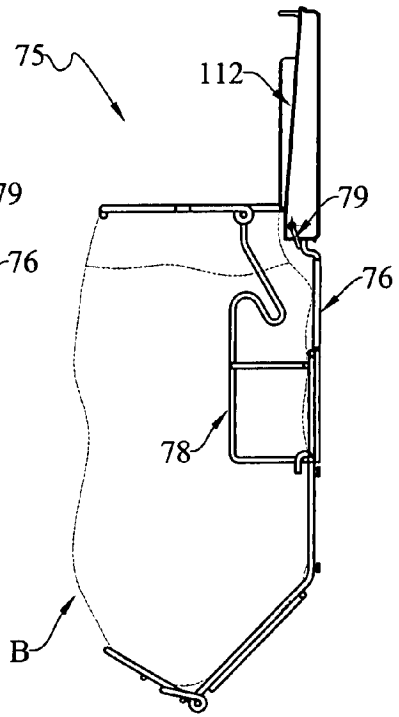
FIG. 10 is a right side elevation of the bag holder shown in FIG. 8, this view showing the lid as having been moved to its raised or upright position, and showing the bag holder support as being in its alternative lower position so as to support a 21 liter bag.
Figure 9:
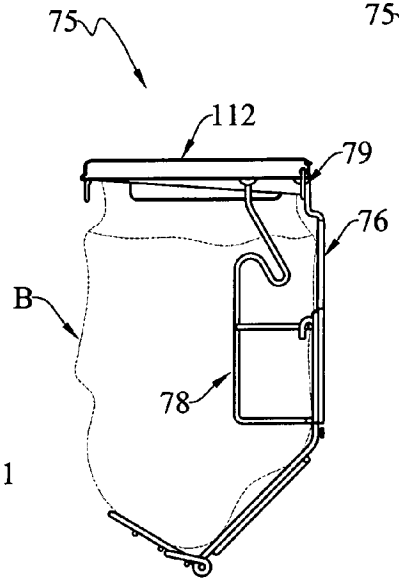
FIG. 9 is a right side elevation of the bag holder shown in FIG. 8, but illustrating the bag support mechanism as being in its upper position so as to support a 15 liter bag.
Figure 8:
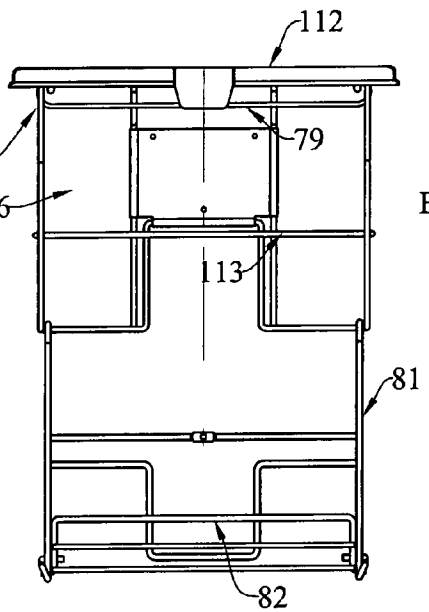
FIG. 8 is a front elevation similar to FIG. 7, and further showing the lid as resting on the top rim member.
Figure 7:
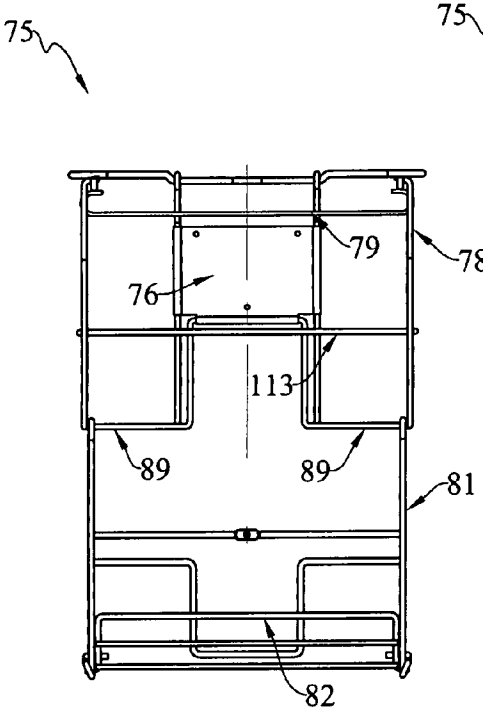
FIG. 7 is a front elevation of a second form of the bag holder, this version being particularly suited for use with 15 and 21 liter bags.

Referring now to FIGS. 7–10, the bag holder is arranged and configured as shown in FIG. 7. If desired, a lid, generally indicated at 112 may be pivotally mounted on the upper portion of the bag frame, with the in-turned marginal end portions of C-shaped member 79 engaging suitable holes in the lid. The bag support subassembly, consisting of bag support members 81 and 82, may be mounted on the bag frame in either of two positions. The first position is shown in FIG. 9, in which the uppermost hooks 102 of the bag support engage a cross bar 113 on the frame. Alternatively, the bag support subassembly may hang from a lower position in which hooks 102 engage frame portions 89. Frame portion 86 is adapted to be captured by the lower C-shaped recess of the bracket. In the preferred embodiment, the frame is so configured, dimensioned and arranged as to support a 15 liter flexible plastic bag when the bag support is in its upper position shown in FIG. 9, and a larger 21 liter bag when the bag support subassembly is in its lower portion as shown in FIG. 10. Lid 112 may be selectively raised or lowered, as shown in FIGS. 9 and 10 to either close the open mouth of the bag, or as to afford access thereto.

Referring now to FIGS. 12–14, lid 112 is seen as being a specially-configured member that has an outer shape adapted to simulate the shape of the top rim member. The lid as a cover 114 joined to the rear of the lid by means of a living hinge 15. The lid is adapted to be selectively opened, as shown in FIG. 13 to expose a recessed compartment 15 in the lid. This compartment 116 is particularly adapted for use in storing fresh bags in a ready-to-use condition. The shape and configuration of the compartment and cover may be readily changed or modified. As best shown in FIG. 14, the lid has openings 118 in its left and right sides to receive the in-turned marginal end portions of C-shaped member 79. Of course, the compartment may store objects other than unused bags, as desired. The lid preferably has a detent and recess to allow the cover to be snapped closed.

Figures 15A, 15B, 15C, 15D, 15E, 15F:
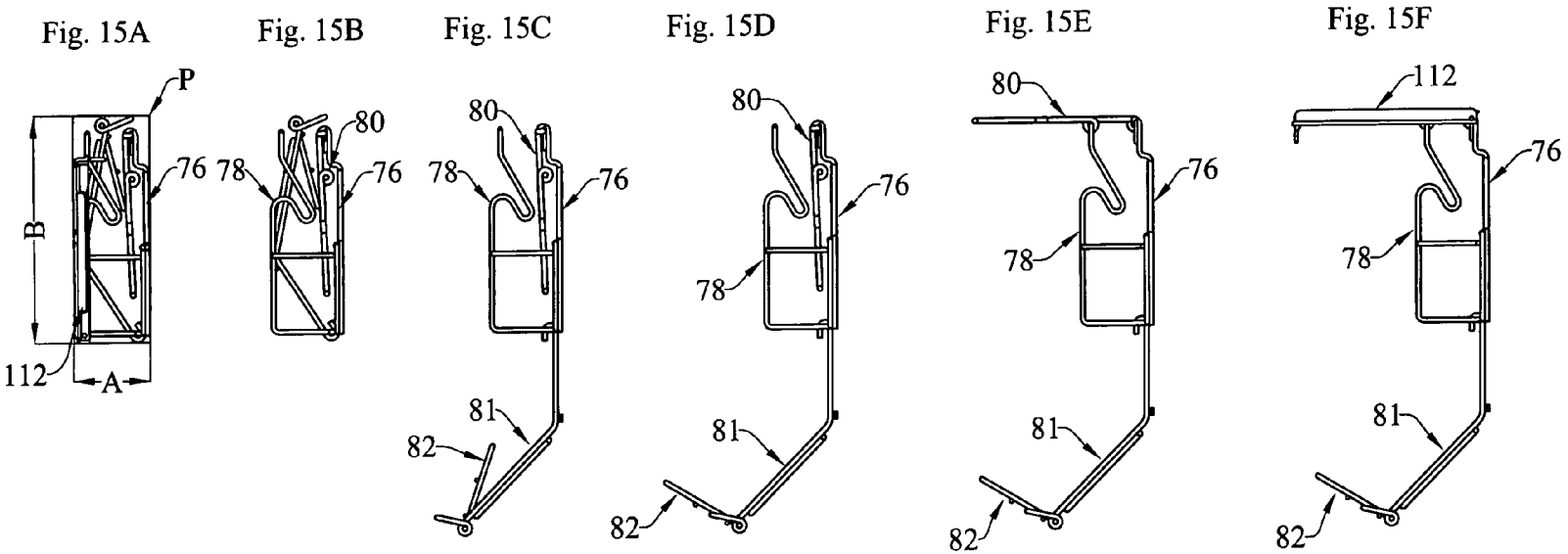
FIG. 15A is a view showing the bag holder depicted in FIGS. 7–13 as being contained within a rectangular package, as for purposes of shipping and display.
FIG. 15B is a view similar to 15A, showing the contents as having been removed from the package, and showing the lid as having been separated from the remaining structure.
FIG. 15C is a view generally similar to FIG. 15B, showing the bag support subassembly as having been removed from the package, and as being operatively hooked onto the bag frame in a lower position, this view also showing the bag frame support second member as having been moved through an angle of about 20° with respect to the bag support first portion.
FIG. 15D is a view generally similar to FIG. 15C, but showing the bag support lower portion as having been pivoted counter-clockwise to its operative bag-supporting position.
FIG. 15E is a view generally similar to FIG. 15D, but showing the top rim member as having been pivoted through an angle of about 90° from its folded position to its outwardly-extending horizontal position, and with the in-turned marginal end portions of the bag frame being received in the top rim eyes.
FIG. 15F is a view generally similar to FIG. 15F, but showing the lid as having placed into its operative position in engagement with the top rim.

FIGS. 15A–15F depict the sequence of unpacking the container and the bag holder from its container and preparing it for use. In FIG. 15A, the bag holder is shown as being contained within a horizontally-elongated package having a rectangular transverse cross section. The width (i.e., dimension "A") is about 3.8125 inches. The height (i.e., dimension "B") of package P is about 3.8125 inches. Hence, the package has a transverse cross-sectional area of less than about 37.0 square inches.

FIG. 15B shows the contents of the package as having been removed from package P, and the lid as having been separated from the other portions.

FIG. 15C shows the bag support subassembly as having been separated from the package, and as having been hung on the bag frame in its lower position.

FIG. 15D shows the bag support lower portion as having been unfolded so as to form an obtuse included angle of about 110° with respect to the bag support upper portion.

FIG. 15E shows the top rim as having been pivoted upwardly, and with the in-turned marginal end portions 118 of the wire rim as having been inserted into top rim eyes 100. Here again, these in-turned marginal end portions may be arranged as at skewed (i.e., non-concentric) angle with respect to the axis of the eye to inhabit unintended separation or withdrawal of the in-turned marginal end portions from the eye.

Finally, FIG. 15F shows the lid 112 as having been placed into operative engagement with the wire-frame, and as being in a horizontal position so as to close the bag. Here again, the bag may be raised or lowered, as desired to afford selective access to the bags.

Modifications

The present invention contemplates that many changes and modifications. For example, the wire-frame members may be formed of a wire or wire-like member, or with a plastic-coated stylet or wire-frame member. The shapes and configurations of the various parts and components may be readily changed or modified, as desired. It may be desirable to incorporate certain hooks for eyes provided in the bags. This is well within the range of someone skilled in the art. As noted above, the bag may be either mounted on a vertical surface, or may be mounted on a stand such that it is able to stand on a horizontal surface, such as a counter top or the like. Whereas the first embodiment was configured and arranged for 6½ liter bags, the second form as a single wire-frame member that is adjustable to accommodate bags of either 15 or 21 liters, as desired. Here again, the particular size or capacity of the bags with which the wire-frame members are associated is exemplary only, and should not be construed as a limitation on the scope of the appended claims unless an expressed limitation to the effect appears therein.

Therefore, while several forms of the improved bag holders have been show and described, and several changes and modifications thereof discussed, persons skilled in this art will readily appreciate that various additional changes and modifications may be made without departing from the spirit of the invention, as defined and differentiated by the following claims.

What is claimed is:

1. A bag holder for holding a bag in an upright and open position, comprising:

a wire-formed member having back portion, a top portion, a left side portion, and a right side portion; and a bag bottom support adapted to be mounted on said member in a first position for supporting a bag of one size, and in another position for supporting a bag of another size;

whereby said bag holder is adapted to hold bags of two different sizes.

2. A bag holder as set forth in claim 1 wherein said back portion has two horizontally-extending bars at vertically-spaced locations thereon.

3. A bag holder as set forth in claim 2 wherein said bag bottom support has at least one hook adapted to be engaged with either of said bars.

4. A bag holder as set forth in claim 1 wherein one of said bag bottom support portions includes a stop for engaging the other of said bag bottom support portions for limiting pivotal movement of said bag bottom second portion relative to said bag bottom first portion.

5. A bag holder as set forth in claim 1 wherein said bag bottom support portions are formed of wire.

6. A bag holder as set forth in claim 1 wherein each of said side portions have integral hook portions that extend toward said back portion.

7. A bag holder as set forth in claim 1 wherein the one size bag is about 15 liters, and the other size bag is about 21 liters.

8. A bag holder as set forth in claim 1 wherein said top portion is of one-piece construction.

9. A bag holder as set forth in claim 1, and further comprising a lid mounted on said top portion.

10. A bag holder as set forth in claim 9 wherein said lid has means for storing a plurality of unused bags.

11. A bag holder as set forth in claim 10 wherein said lid has a compartment for storing bags, and a cover for selectively closing said compartment.

12. A bag holder as set forth in claim 11 wherein said lid is formed of a flexible polymer, and is of one-piece construction.

13. A bag holder for holding a bag in an upright and open position, comprising:

a wire-formed member having a back portion, a left side portion, a right side portion, and a top portion;

said top portion being pivotally connected to said back portion and adapted to be moved between a first position at which said top portion lies adjacent said back portion, and a second position at which said top portion extends away from said back portion substantially at a right angle relative thereto;

wherein said top portion has eyes formed therein; and wherein said left and right side portions have in-turned marginal end portions that are adapted to be received in said top portion eyes when said top portion is in said second position to hold said top portion in said second position.

14. A bag holder as set forth in claim 13 wherein the axis of at least one in-turned end portion is not coincident with the axis of the associated eye.

15. A bag holder as set forth in claim 13, and further comprising:

a bag bottom support adapted to be mounted on said wire-formed member in a first position for supporting a bag on one size, and in another position for supporting a bag of another size;

whereby bag holder is adapted to hold bags of two different sizes.

16. A bag holder as set forth in claim 15 wherein said bag bottom support is adapted to be selectively attached to said back portion.

17. A bag holder as set forth in claim 15 wherein said bag bottom support has a first portion adapted to be selectively attached to said back portion, and a second portion pivotally mounted on said first portion and adapted to be selectively moved between a first position at which said second portion is adapted to lie adjacent said first portion, and a second position at which said second position is adapted to be supported at an obtuse included angle relative to said first portion.

18. A bag holder as set forth in claim 13, and further comprising:

a lid adapted to rest on said top portion when said top portion is in said second position.

19. A bag holder as set forth in claim 18 wherein said top portion is of one-piece construction.

20. A bag holder as set forth in claim 18 wherein said bag holder is adapted to be used with bags having a capacity of about 21 liters, and wherein said wire-frame member, said bag bottom support and said lid may be placed into an elongated rectangular package having a transverse cross-sectional area of about 36.69 square inches for shipping.

21. A bag holder as set forth in claim 20 wherein the transverse dimensions of said package are about 3.8125 inches by about 9.625 inches.

* * * * *

UNITED STATES PATENT AND TRADEMARK OFFICE

CERTIFICATE OF CORRECTION

PATENT NO. : 7,175,139 B2
APPLICATION NO. : 10/987617
DATED : February 13, 2007
INVENTOR(S) : Nicholas C. Broeders It is certified that error appears in the above-identified patent and that said Letters Patent is hereby corrected as shown below:

Column 12, Lines 5-15 (Claim 1):

"1. A bag holder for holding a bag in an upright and open position, comprising:
a wire-formed member having back portion, a top portion, a left side portion, and a right side portion; and
a bag bottom support adapted to be mounted on said member in a first position for supporting a bag of one size, and in another position for supporting a bag of another size;
whereby said bag holder is adapted to hold bags of two different sizes." should be --1. A bag holder for holding a bag in an upright and open position, comprising:
a wire-formed member having back portion, a top portion, a left side portion, and a right side portion; and
a bag bottom support adapted to be mounted on said member in a first position for supporting a bag of one size, and in another position for supporting a bag of another size;
said bag bottom support including a first portion that is adapted to be attached to said member, and a second portion that is pivotally connected to said first portion;
whereby said bag holder is adapted to hold bags of two different sizes.--

Signed and Sealed this

Sixteenth Day of February, 2010

David J. Kappos

David J. Kappos
*Director of the United States Patent and Trademark Office*